United States Patent [19]

Piro

[11] 4,046,102

[45] Sept. 6, 1977

[54] YARN PARAFFINING DEVICE

[75] Inventor: Mario Piro, Genoa, Italy

[73] Assignee: Nuova San Giorgio S.p.A., Genoa-Sestri, Italy

[21] Appl. No.: 676,469

[22] Filed: Apr. 13, 1976

[30] Foreign Application Priority Data

Apr. 14, 1975 Italy ..... 22307/75

[51] Int. Cl.[2] ..... B05C 11/00

[52] U.S. Cl. ..... 118/78; 184/15 R; 242/36

[58] Field of Search ..... 118/76, 77, 78, DIG. 22; 28/59; 57/35; 184/15 R; 242/35.5, 36

[56] References Cited

U.S. PATENT DOCUMENTS

| | | | |
|---|---|---|---|
| 960,335 | 6/1910 | Kahn | 118/78 |
| 2,014,127 | 9/1935 | Coley et al. | 118/78 |
| 3,168,992 | 2/1965 | Zollinger | 118/78 X |
| 3,306,253 | 2/1967 | Frentzel-Beyme | 118/78 X |
| 3,358,641 | 12/1967 | Gfeller | 118/78 |
| 3,479,988 | 11/1969 | Trost et al. | 118/78 |
| 3,802,382 | 4/1974 | Koller | 118/78 |
| 3,890,924 | 6/1975 | Horstmann | 118/78 |

*Primary Examiner*—James Kee Chi

[57] ABSTRACT

Device for yarn paraffining with solid paraffin in textile machines. The device comprises a block of paraffin carried by a support rotating on and sliding along a pin; a lever acting against the paraffin support and a return spring connected to the lever at a connection location angularly rearwardly displaced relative to the lever end acting on said paraffin support.

12 Claims, 4 Drawing Figures

FIG. 1
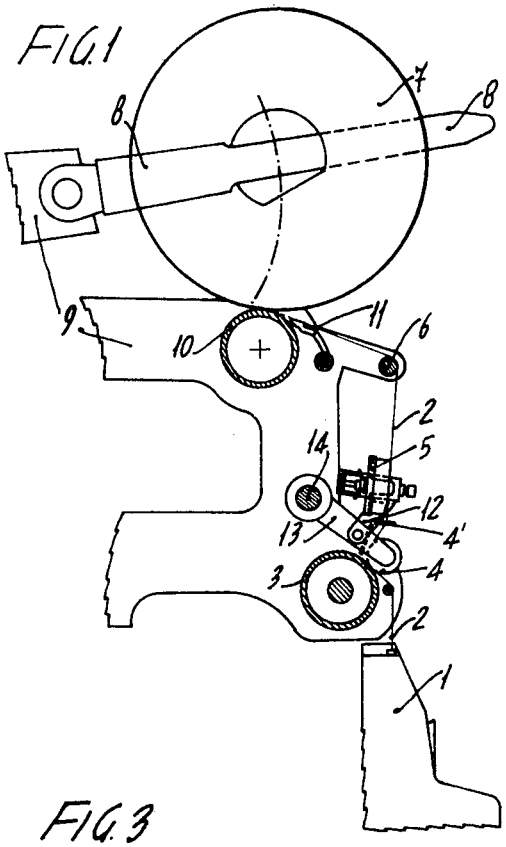
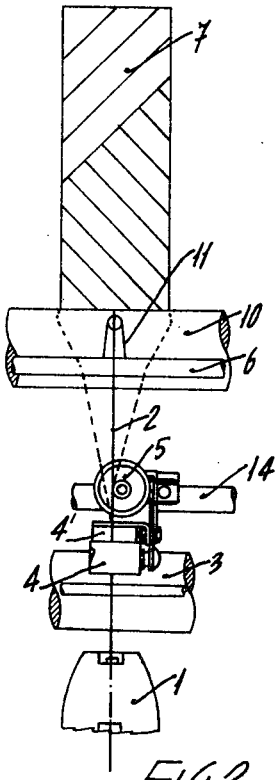
FIG. 2
FIG. 3
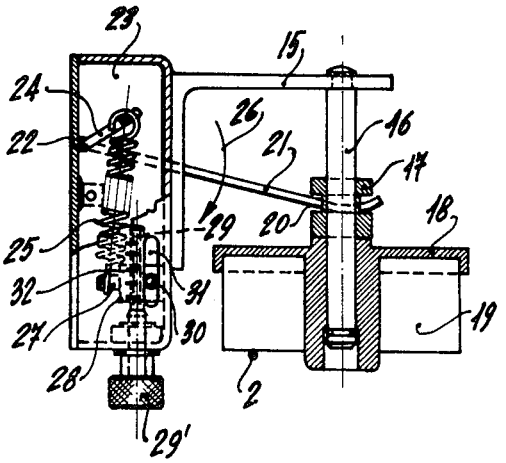
FIG. 4
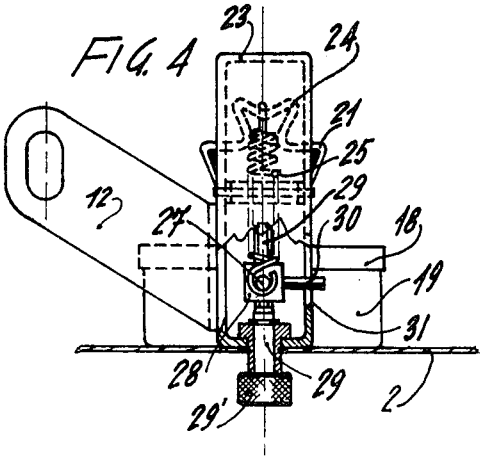

YARN PARAFFINING DEVICE

This invention relates to a yarn paraffining device in general and particularly for open end spinning machines, by solid paraffin.

Paraffining devices are known and particularly a device is known from French Pat. No. 2,141,086, in which a cylindrical block of paraffin is freely rotatably carried by a slanting pin or shaft to adhere by its own weight against the yarn to be paraffined.

However, such a known device suffers from remarkable disadvantages, the major of which consists of its incapability of maintaining a constant pressure of the paraffin on the yarn, both upon paraffin weight decrease occurring as the paraffin is getting consumed, and as the yarn tension changes.

According to the invention, it is assumed that to effect a good paraffin application to a yarn, it is essential that pressure of the paraffin on the yarn be maintained constant independently of the changes in weight of paraffin due to consumption of the latter.

In a paraffining device it is also important to assure that the differences in yarn tension be immediately sensed and compensated for in order to control the paraffin pressure constancy. In the above mentioned device, compensation of paraffin pressure can by only partially and discontinously effected, as pressure compensation is not immediate and is adversely affected by either said paraffin consumption or more or less high friction between said sloping pin and paraffin block holder.

Therefore, it is a first object of the present invention to provide a yarn paraffining device for textile machines, capable of maintaining always constant pressure of the paraffin on the yarn independently of changes in weight of a paraffin block due to consumption. For purpose of the present specification, with the term "textile machine" is intended any spinning machine and any other machine for treatment of yarn before weaving.

It is a further object of the present invention to provide a paraffining device of the above character, capable of immediately and automatically compensating for a possible reduction in yarn tension, so that paraffin pressure and yarn paraffining rate are maintained constant, not being substantially affected by possible frictions otherwise retarding the sliding motion of the paraffin block.

The problem has been solved by a paraffining device according to the invention, in which a paraffin block is carried by a support freely rotable and slidable along a fixed pin, which device comprises a push lever freely acting against the rotating paraffin support, that is to allow for both rotation of the paraffin support and lever movement relative to the support to enable said paraffin block to slide on the fixed carrying pin, and in which a resilient push means is provided as connected to said lever at a connection location angularly rearwardly displaced relative to the direction of rotation for said lever, thus compensating for the reductions in stresses of the resilient means occurring on consumption of said paraffin block.

It is also known that the ideal amount of paraffin to apply to a yarn should be such as to reduce the friction coefficient of the latter to 40–50%. Such an ideal amount of paraffin to be applied to a yarn has to be found by trial, that is by varying the paraffin pressure on the yarn as dependent on both the yarn characteristics and type of paraffin used.

According to the prior art paraffining device, the paraffin pressure on the yarn can only be varied by using paraffin supports of a different weight.

Thus, such a system does not permit a continuous adjustment and adaptability to all of the practical conditions, further requiring to discontinue paraffing operation whenever the paraffin support weight has to be varied.

According to the invention, a paraffining device is provided with an adjustment device for the paraffin pressure on the yarn, which can be manually and continuously adjusted without discontinuing the paraffining operation. This has been accomplished by connecting the spring acting upon the push lever to a sliding member movable along a guideway and an a threaded pin, which can be manually rotated during operation of the textile machine.

The sliding member is also provided with a finger indicating the pressure rate relative to a fixed scale which, for example, is carried by the support casing for the paraffining device. Therefore, in addition to affording adaptability and paraffining pressure adjustment, a device according to the invention provides for indicating the pressure rate, thereby enabling, where such a device is used to a large extent on the various working stations of a textile machine, to readily adjust the various paraffining devices identically to one another for all of the machine working stations. This system permits a substantial reduction in time required for setting all of the paraffining devices provided on a textile machine.

The invention will now be more fully described in connection with the exemplary embodiment of the accompanying drawings, in which:

FIG. 1 is a side view showing a working station of an open end spinning machine, provided with a paraffining device according to the invention;

FIG. 2 is a front view of FIG. 1;

FIG. 3 is an enlarged plan view showing the paraffining device of FIG. 1; and

FIG. 4 is a side view showing the paraffining device of FIG. 3.

FIGS. 1 and 2 of the accompanying drawings shown partial views of a working station for an open end spinning machine, wherein a spinning unit 1 continuously produces a yarn 2 which is caused to pass into the nip between an withdrawing cylinder 3 and a pressure roller 4, then on a lower guide 4' and in front of a paraffining device 5, to be hereinafter described. Next, the yarn passes on an overlying guide 6 and is then wrapped up on a bobbin 7 carried by swinging arms 8 pivoted to the spinning machine frame 9. Said bobbin 7 is continuously rotated by a winding up cylinder 10, whereas a yarn dispensing device 11 provides for moving yarn 2 between the end positions of the reel, as shown by dashed lines in FIG. 2.

As shown in FIG. 1, paraffining device 5 is carried at 12 by an arm 13 carrying the above mentioned pressure roller 4 and which is pivoted at 14 to a bar extending longitudinally of the spinning frame.

Therefore, it is evident that yarn 2, as produced by the spinning unit and after being withdrawed therefrom, will pass in front of and in contact with the paraffin block of said paraffining device, and then wound up on bobbin 7.

Referring now to FIGS. 3 and 4, a specific embodiment of a paraffining device according to the invention will be more particularly described.

As shown in FIG. 3, the device comprises a support or bearing 15 for a pin 16, freely slidably carrying thereon a push bushing 17 acting against a support or bearing 18 carrying a cylindrical block of solid paraffin 19, yarn 2 sliding at contact therewith. Paraffin support 18 is freely slidable along and rotable on pin 16.

Bushing 17 has a circular groove 20, in which a push lever 21 is freely engaged, that is allowing a relative sliding movement.

Push lever 21 is pivoted at 22 to a casing or box-member 33 integral with support 15 and has a second arm 24 having connected thereto a traction spring 25 which is effective to cause said push lever 21 to clockwise rotate or to rotate in the direction of arrow 26, and accordingly a forward sliding movement of bushing 17 and paraffin support 18 for imparting the desired paraffining pressure on yarn 2.

As shown in FIG. 3, arm 24 of lever 21 determining the connection location for spring 25 is located rearwardly of the lever, forming with the latter an angle less than 90°. Thus, the paraffining pressure on yarn 2 is maintained at a constant rate, automatically compensating for paraffin consumption. This is due to the fact that any reduction in tension for spring 25, as a result of consumption of paraffin 19 is automatically compensated for by an increase or extension in the lever arm for the connection location of spring 25, as measured perpendicularly to the direction of the force exerted by said spring. Thus, having defined the characteristics and starting tension to impart to spring 25, depending on the paraffining rate desired on yarn 2, a perfect constant paraffining pressure can be assured on yarn 2. Additionally, the provision of spring 25 and action of pressure lever 21 would assure that any differences in tension of the yarn are immediately sensed and automatically controlled.

As previously mentioned, the ideal amount of paraffin to be given to a yarn is generally experimentally determined time by time. Therefore, it would be desirable to vary the paraffin pressure on the yarn in order to take into account not only the type of yarn, but also the type of parrafin used. To do this, the starting tension of pressure spring 25 can be suitably varied and adjusted.

To this end, as shown in FIGS. 3 and 4 of the accompanying drawings, spring 25 is at one end thereof connected to arm 24 of pressure lever 21, or to another part integral with said lever or wholly equivalent, while at its other end is anchored to a peg 27 laterally projecting from a block 28 guided by the inner wall of said casing or box member 23 and movable along a threaded pin 29. Pin 29 is rotably carried by casing or box member 23 and projects therefrom by and end 29′ thereof to allow for manual operation. Thus, by acting upon pin 29, causing it to rotate in one direction or in the opposite direction, a forward or rearward sliding movement is determined for block 28 and accordingly a larger or smaller tension of spring 25 with a resulting change in pressure for paraffin block 19 on yarn 2. As apparent, adjustment for spring 25 could be provided in any other manner, still providing a movable hooking or connecting element for the spring, the position of which can be adjusted.

Frequently, it would be convenient to have an indication of the starting tension rate of spring 25 in order to identically set the paraffining devices relating to each of the working stations of the textile machine.

To this end, the paraffining device has been provided with a finger 30 integral with the sliding block 28 for the spring connection, which finger 30 projects from a longitudinal slit 31 of supporting casing or box member 23 at a scale 32 which, for example, is marked or printed on the outer surface of said casing or box member, as schematically shown in FIG. 3 of the accompanying drawings.

Thus, it is evident that in such a way the various devices on a machine can be always set to the same paraffining conditions, the characteristics of the paraffin and yarn to be paraffined being unaltered. Such an adjustment can be also very simpley effected and with the textile machine in operation, that is without having to discontinue the paraffining operation.

The operation of the device according to the invention is as follows. Yarn 2, as produced by spinning unit 1, is withdrawed and upward moved for winding up on bobbin 7. During its movement, the yarn due to yarn distributing movement on the bobbin, will contact slide and slip against the end surface of paraffin block 19, which is thus rotably driven causing an even and smooth consumption of the paraffin. As the paraffin block thickness is reduced by consumption, spring 25 will act upon push lever 21 for forward movement of bushing 17 and accordingly paraffin support or holder 18, thus maintaining a constant pressure on the yarn. Similarly, said spring 25 is effective when a sudden drop in the yarn tension occurs, forwardly pushing the paraffin to maintain the paraffining pressure at a constant rate.

As the yarn and paraffin characteristics vary, a new rate of paraffining pressure would have to be determined, which can be accomplished be acting upon adjustment pin 29 by causing it to rotate in one direction or in the opposite direction in order to increase or decrease the tension of said spring 25.

What is claimed is:

1. Apparatus for applying paraffin to a yarn filament comprising a frame, a longitudinally extending pin supportable in a fixed positional relationship to said frame, a paraffin block support member comprising a paraffin block support surrounding said longitudinally extending pin and being freely rotatable relative to the longitudinal axis of said pin, said paraffin block support being mounted for slidable movement longitudinally with respect to said pin, means for applying a force to said paraffin block support for urging said paraffin block support in a first longitudinal direction relative to said pin comprising a lever mounted for pivotal movement about a pivot axis which is fixed with respect to said pin, said lever having a portion engageable with a portion of said paraffin block support, spring means for urging said lever in a forward rotational direction about said pivot axis for applying a force couple to said lever arm for urging said paraffin block in said first longitudinal direction, said spring means including means for maintaining a substantially constant force couple about said pivot axis for all operative pivotal movements of the lever arm about said pivot axis.

2. Apparatus as defined in claim 1 wherein said lever is pivotally moveable in a forward rotational direction for moving said paraffin block support in said first longitudinal direction, said lever including a first lever arm portion extending through said pivot axis and engaging said paraffin block support and a second lever arm portion extending through said pivot axis and extending rearwardly of said first lever arm with respect to the forward direction of movement, said second lever arm portion being angularly disposed with respect to said first lever arm.

3. Apparatus as defined in claim 2 wherein said second lever arm is disposed at an acute angle with respect to said first lever arm.

4. Apparatus as defined in claim 3 wherein said spring means includes means for applying said spring force to said second lever arm at an acute angle with respect to said second lever arm.

5. Apparatus as defined in claim 4 including means for adjusting the magnitude of said spring means.

6. Apparatus as defined in claim 5 wherein said means for adjusting the magnitude of said spring means includes a block member adjustably supportable in a fixed position relation to said frame, said spring means including a spring member connected to said second lever arm and to said block member.

7. Apparatus as defined in claim 6 wherein said means for adjusting the force of said spring means includes a finger member connected with said block member and moveable therewith relative to a fixed scale for indicating the spring force.

8. Apparatus as defined in claim 1 wherein said lever includes first and second lever arms pivotal about said pivot axis, said spring means being connected with a portion of said second arm and being connected with a moveable connecting member whose position is adjustable relative to said frame for adjusting the tension in the spring, said spring means being effective to rotate said lever in a forward direction and said second lever arm being disposed angularly and rearwardly with respect to said first lever arm.

9. Apparatus as defined in claim 8 wherein said movable connecting member includes a finger moveable relative to a fixed scale for indicating the force in the spring.

10. Apparatus as defined in claim 1 including a push bushing disposed against said paraffin support block, said push bushing defining a circular groove for receiving a portion of a first arm of said lever, said lever further including a second arm having a portion connected with a portion of a spring, said spring acting on said lever to urge said lever in said forward rotational direction, said second lever arm being disposed angularly and rearwardly with respect to said first lever arm.

11. Apparatus as defined in claim 10 wherein said spring is further connected to a block member which is adjustably moveable relative to the frame of said paraffining device.

12. Apparatus as defined in claim 11 wherein said block member includes a finger projecting from a longitudinal slit in the frame and moveable relative to a fixed scale on the frame.

* * * * *